US011247867B2

(12) United States Patent
Ikeda

(10) Patent No.: US 11,247,867 B2
(45) Date of Patent: Feb. 15, 2022

(54) SHEET FEEDING DEVICE

(71) Applicant: CANON KABUSHIKI KAISHA, Tokyo (JP)

(72) Inventor: Masahito Ikeda, Koshigaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 25 days.

(21) Appl. No.: 16/745,914

(22) Filed: Jan. 17, 2020

(65) Prior Publication Data

US 2020/0231402 A1 Jul. 23, 2020

(30) Foreign Application Priority Data

Jan. 21, 2019 (JP) ..... JP2019-008083

(51) Int. Cl.
*B65H 7/02* (2006.01)
*B65H 43/04* (2006.01)
*B65H 29/12* (2006.01)

(52) U.S. Cl.
CPC ..... *B65H 43/04* (2013.01); *B65H 7/02* (2013.01); *B65H 29/125* (2013.01); *B65H 2553/20* (2013.01)

(58) Field of Classification Search
CPC .... B65H 2301/5133; B65H 2301/5321; B65H 5/062; B65H 5/36; B65H 5/38; B65H 2404/61; B65H 2404/611; B65H 29/125; B65H 7/02; B65H 7/125; B65H 7/12; B65H 43/04; B65H 2553/20
See application file for complete search history.

(56) References Cited

U.S. PATENT DOCUMENTS

| | | | | |
|---|---|---|---|---|
| 5,822,655 | A | 10/1998 | Ikeda | |
| 10,057,440 | B2 | 8/2018 | Ikeda | |
| 2013/0134655 | A1* | 5/2013 | Nakayama | B65H 7/02 271/111 |

FOREIGN PATENT DOCUMENTS

| | | | |
|---|---|---|---|
| JP | 63295344 | A | * 12/1988 |
| JP | 2003295347 | A | * 10/2003 |
| JP | 2005-162342 | A | 6/2005 |

* cited by examiner

*Primary Examiner* — Luis A Gonzalez
(74) *Attorney, Agent, or Firm* — Venable LLP

(57) ABSTRACT

A sheet feeding device includes a feeding guide of resin material constituting a sheet feeding path along which a sheet is fed; a feeding roller for feeding the sheet along the feeding path, the feeding roller being provided with a metal shaft; a sheet sensor configured to detect the sheet fed along the sheet feeding path; and a grounding member electrically grounding the shaft. The feeding guide has a guiding surface for guiding the sheet, and the guiding surface is provided with a hole portion for exposing the shaft to the sheet feeding path.

13 Claims, 6 Drawing Sheets

SHEET FEEDING DEVICE

FIELD OF THE INVENTION AND RELATED ART

The present invention relates to a sheet feeding device for conveying a sheet of recording medium or the like.

An image forming apparatus such as a copying machine and a printer yields a print by forming a toner image in its image forming portion, transferring the toner image onto a sheet of recording medium conveyed one by one to the image forming portion, and fixing the toner image to the sheet, or projecting ink onto the sheet. Many recent image forming apparatuses such as copying machines and printers are equipped with an image reading apparatus which is capable of reading an image by scanning an original placed on its glass platen which is greater in size than the original. Further, some of these image reading apparatuses are capable of reading an original not only while the original is kept stationary on the glass platen, but also, while the originals are conveyed one by one by its automatic document feeder) (ADF).

If an original comes into contact with the following original or the sheet guide while it is conveyed, static electricity is generated. Consequently, not only is the original, which is being conveyed, charged by this static electricity, but also, the following originals, and/or the tray or the like in which the following originals are. If an original which has become charged as described above is conveyed through the sheet passage of the apparatus, it discharges static electricity to various portions of the sheet passage. By the way, generally speaking, there are provided sensors for detecting an original, along the passage through which the original is conveyed. These sensors are provided with an electronic circuit board, which is enclosed in a case.

Generally speaking, it is not desirable to place a statically charged object in the adjacencies of an electronic circuit board, because a piece of copper film formed by printing on a substrate, and an element such as an IC formed on the substrate by printing are likely to attract static electricity, and therefore, the static electricity is likely to be discharged to the copper film and ICs. As the static electricity is discharged to these film and/or elements, it is possible that the pieces of extremely thin film of copper might partially come off from the substrate, and/or the ICs might be damaged, which may make it possible for the electronic circuit to malfunction.

Therefore, if it is necessary to place the aforementioned sensors in the passage of an original, or in the adjacencies of the passage, a measure for preventing the occurrence of the abovementioned issues has to be taken. In Japanese Laid-open Patent Application No. 2005-162342, for example, it is disclosed to cover an electronic circuit board for detecting whether or not an original is on a sheet feeder tray, with a piece of plate which is grounded.

By the way, a sensor such as the one described above, which is for detecting an original, has a substantial amount of effect on a sheet feeding device in productivity in terms of original conveyance performance. Generally, therefore, they are afforded latitude in terms of positioning. Further, recent apparatuses are substantially smaller in size, and are higher in component density. Therefore, if an attempt is made to place the sensors as close as possible to a sheet conveyance roller to satisfy a user in the sensor performance, it is sometimes impossible to place an electrically conductive member such as the abovementioned piece of grounded plate in the adjacencies of the sensor.

SUMMARY OF THE INVENTION

Thus, the primary object of the present invention is to provide a sheet feeding device which is capable of protecting a sensor for detecting a sheet of recording medium or the like, from static electricity.

According to an aspect of the present invention, there is provided a sheet feeding device comprising a feeding guide of resin material configured to constitute a sheet feeding path along which a sheet is fed; a feeding roller configured to feed the sheet along the feeding path, said feeding roller being provided with a metal shaft; a sheet sensor configured to detect the sheet fed along the sheet feeding path; and a grounding member configured to electrically ground said shaft, wherein said feeding guide has a guiding surface configured to guide the sheet, and said guiding surface is provided with a hole portion configured to expose the shaft to said sheet feeding path.

Further features of the present invention will become apparent from the following description of exemplary embodiments with reference to the attached drawings.

DESCRIPTION OF THE EMBODIMENTS

Hereinafter, the present invention is described with reference to an image forming apparatus equipped with a sheet feeding device which is in accordance with the present invention, and appended drawings. By the way, the present invention is described with reference to a sheet feeding device, with which the ADF of a copying machine is provided. However, this sheet feeding device may be employed by an image forming apparatus such as a printer, a facsimile machine, or a multifunction apparatus capable of functioning as the preceding apparatuses, in addition to the copying machine. Further, in the following description of the present invention, a "sheet" of recording medium includes not only a sheet of ordinary paper, but also, a sheet of special paper such as coated paper, an envelope, a sheet of index paper or the like having a specific shape, a sheet of plastic film for an overhead projector, a sheet of fabric, and the like. In addition, an original itself also is included in the concept of "sheet". Further, it is assumed here that an original is a plane sheet of paper, or a sheet of paper having an image on only one of its surface, or both surfaces. Moreover, in the following description of the present invention, the side of the image forming apparatus which faces a user is referred to as the front side, and the opposite side of the apparatus from the front side is referred to as the rear side. Further, regarding the orientation of the image forming apparatus, the direction which is parallel to the front-rear direction is referred to as the front-rear direction, and the direction which is parallel to the front-rear direction of the apparatus is referred to as the widthwise direction of the apparatus.

Embodiment 1

Figure 1:
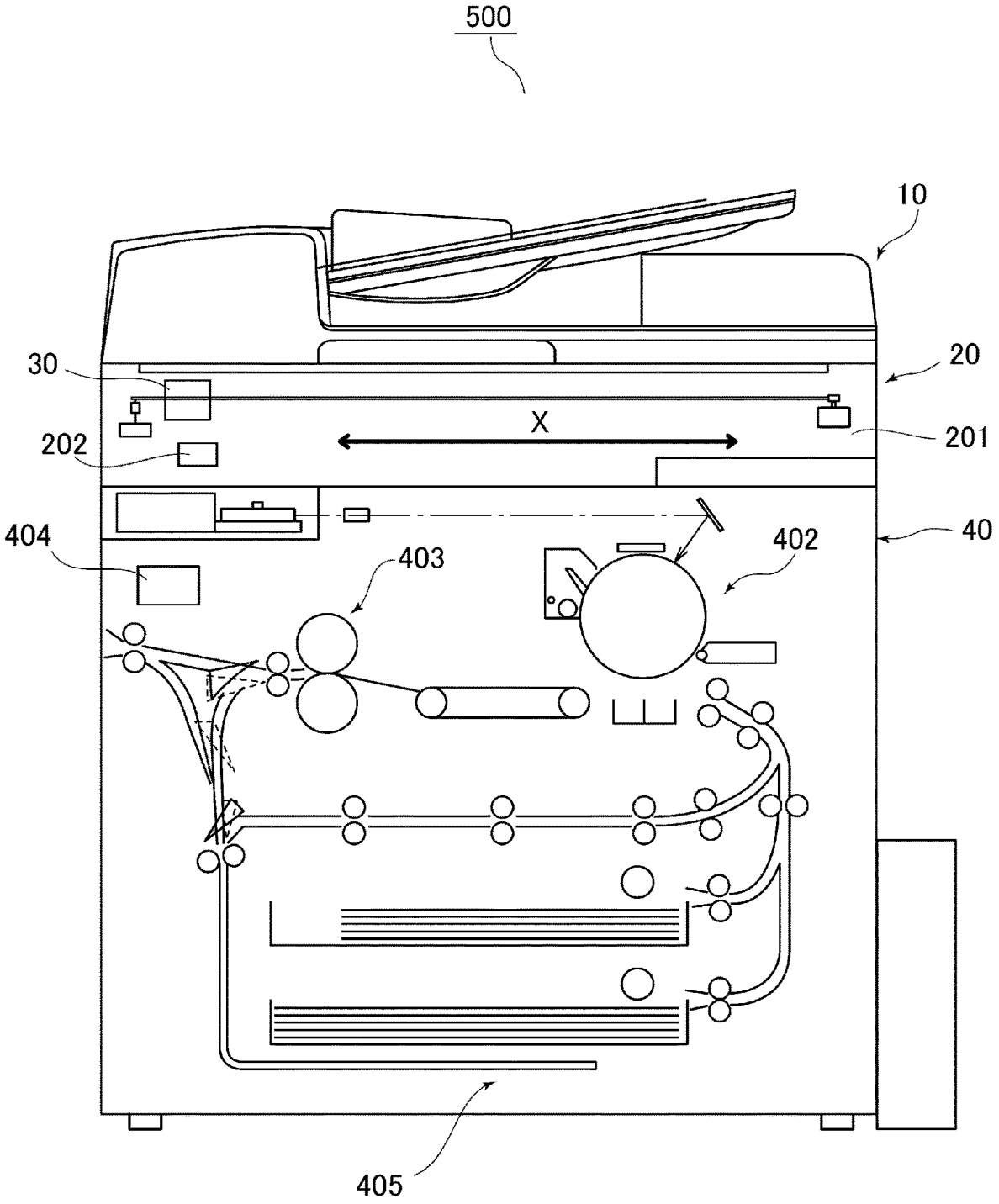
FIG. 1 is a schematic drawing of the image forming apparatus in the first embodiment of the present invention.

FIG. 1 is a schematic sectional view of the copying machine 500 as the image forming apparatus in the first embodiment of the present invention. The copying machine 500 is provided with an image reading apparatus 20 for reading the image of an original. The image reading apparatus 20 is on the top side of a printing portion 40 as the main portion of the image forming apparatus. The copying machine 500 is also provided with an ADF 10, which is on the top side of the image reading apparatus 20.

The printing portion 40 contains a sheet conveying portion 405 for conveying a sheet of recording medium, and an electrophotographic image forming portion 402, which forms an image on a sheet of recording medium conveyed from the sheet conveying portion 405. Further, it is provided with a fixing portion 403 for heating and pressing an unfixed toner image transferred onto a sheet of recording medium by the image formation engine 402, to fix the unfixed toner image to the sheet of recording medium, and a printer controlling portion 404 which controls the printing portion 40.

The image reading apparatus 20 is provided with an original placement platen 201 as a means on which an original is to be placed, and an image reading means 30 which is placed on the inward side of the original placement platen 201 to read the image of the original placed on the original placement platen 201. Further, it is provided with an image reading apparatus controlling portion 202 as a controlling means for controlling the image reading apparatus 20.

If a user wants to make a copy of an original with the use of the copying machine 500 described above, the user is to follow the following procedure. First, the user is to press a copy button (unshown). As the button is pressed, the image reading means 30 described above reads the image of the original while moving in the secondary scan direction X (which in this embodiment is widthwise direction). The information of the image obtained by the image reading means 30 is transmitted to the printer controlling portion 404 by way of the image reading apparatus controlling portion 202. Then, a toner image of the original is formed in the image formation engine 402, based on the transmitted information of the image. This toner image is transferred onto a sheet of recording medium conveyed to the image formation engine 402 from the sheet conveying portion 405. Then, the unfixed toner image on the sheet is heated and pressed in the fixing portion 403. As the unfixed toner image is heated and pressed, it becomes fixed to the sheet. After the fixation of the unfixed toner image to the sheet, the sheet is discharged out of the copying machine 500, ending the process of copying the original.

In a case where a copy (copies) of each of two or more originals is made, the following sequence is carried out by the copying machine 500. First, the two or more originals are conveyed one by one by the ADF 10. While each original is conveyed, the image of the original is read by the image reading means 30, which is in its preset reading position. By the way, while the image reading method which reads an original with the use of image reading means 30 while the image reading means 30 is moved in the secondary scan direction is referred to as "static reading method", the reading method which reads an original with the use of the image reading means 30 while the original is read by the stationary image reading means 30 while the original is conveyed by the ADF 10 is referred to as "conveyance reading method".

General Structure of Image Reading Apparatus

Figure 2:
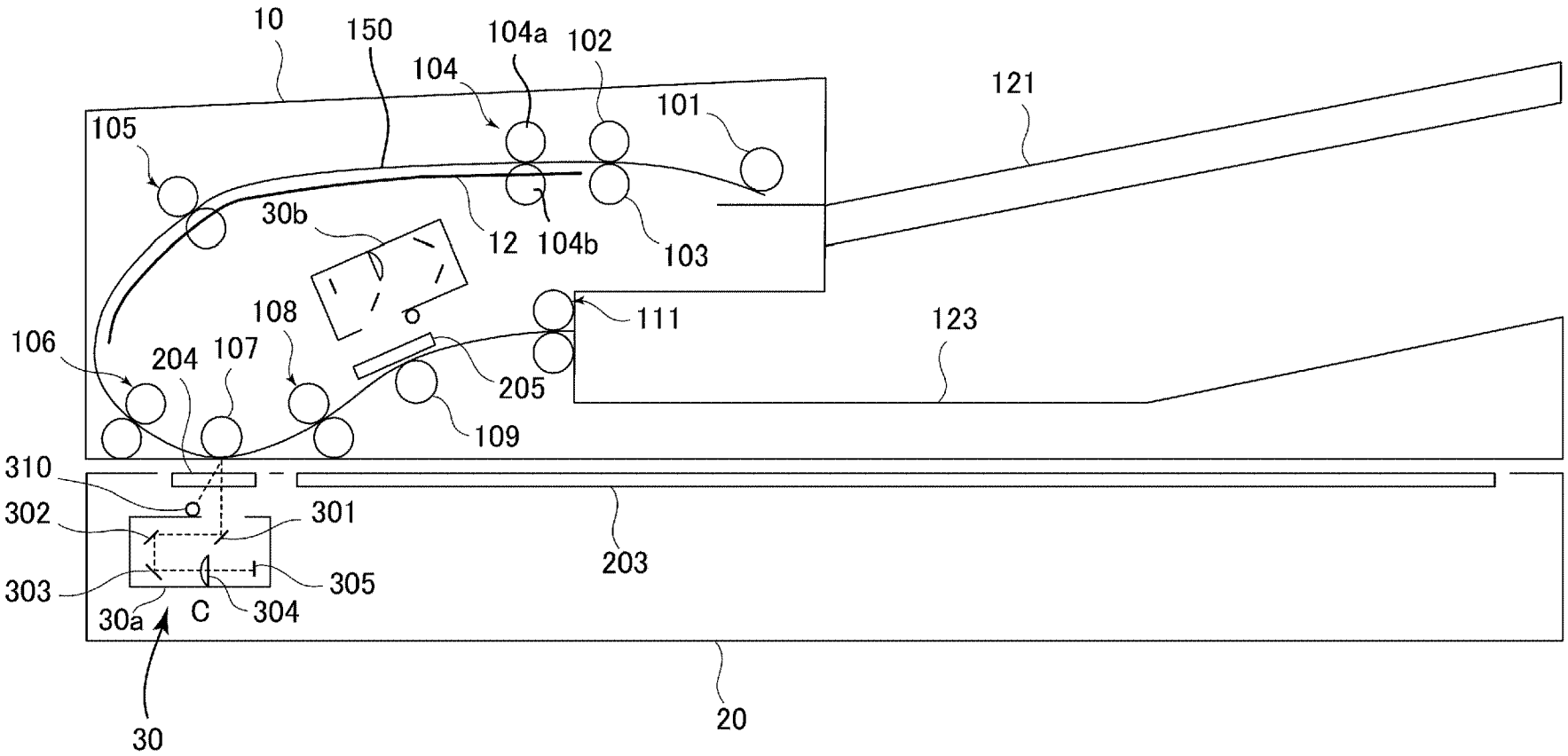
FIG. 2 is a sectional view of a combination of the ADF and image reading apparatus while originals are conveyed for reading.
Figure 3:
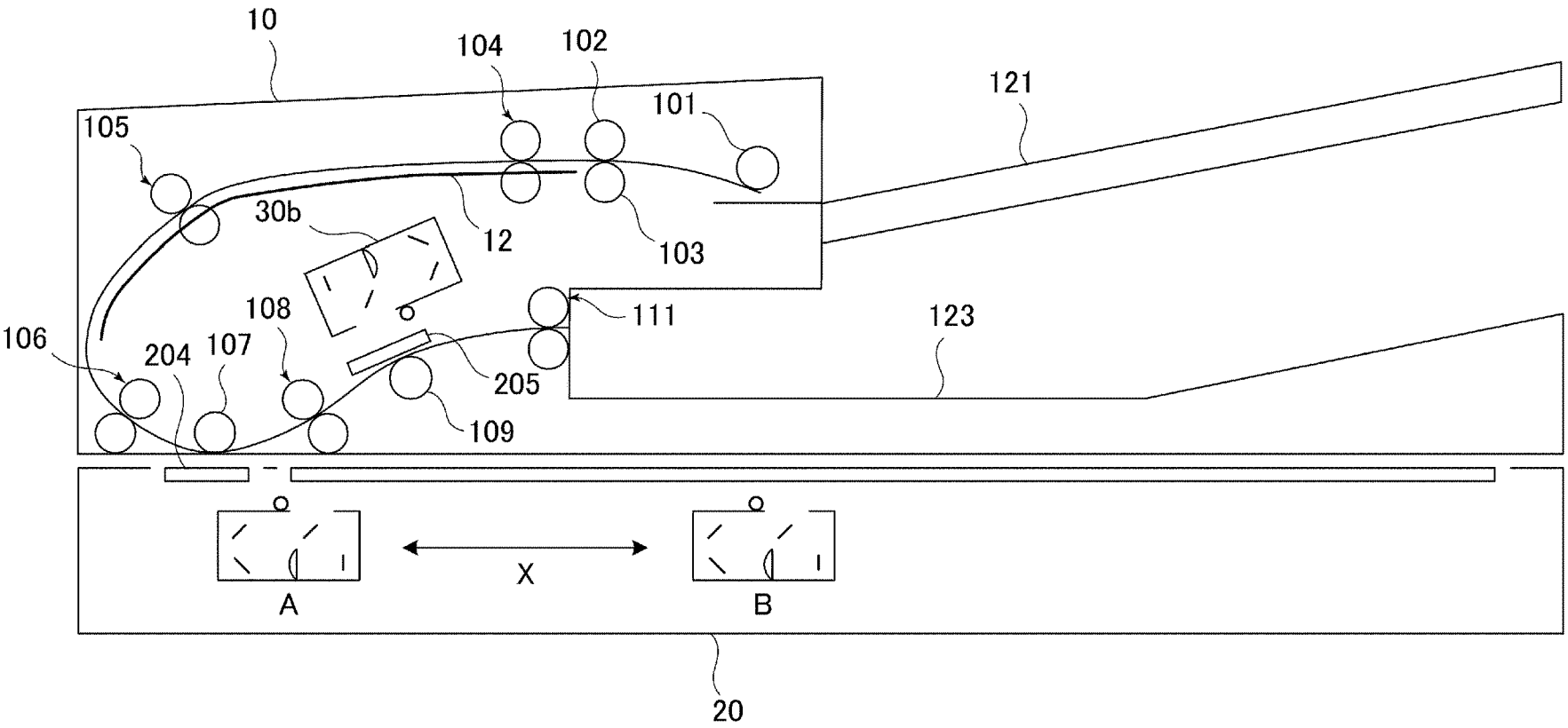
FIG. 3 is a sectional view of the ADF and image reading apparatus while an original is kept stationary for reading.

Next, referring to FIGS. 2 and 3, the structure of the image reading apparatus 20 is described. Referring to FIG. 2, the image reading apparatus 20 is structured so that its image reading means 30 is movable in the internal space of the original placement platen 201. This image reading means 30 is provided with an image reading optical box 30*a* (scanner), which has a light source 310 which projects light on the image bearing surface of an original, mirrors 301, 302 and 303 which guide the light projected by the light source 310 and diffusively reflected by the original, to the focusing lens 304, a charge coupled device 305, etc. The reading optical box 30*a* is in connection to an unshown motor by way of an unshown timing belt. It is reciprocally movable in the direction X shown in FIG. 3.

In a case where an original is read with the use of the static reading method, the original is placed on a glass platen 203 for the static reading, and the reading optical box 30*a*, which is kept on standby in its initial stand-by position, is moved in the direction X, at a preset speed, to a position B, shown in FIG. 3, if the size of the original is A4, for example.

In a case where the original is read with the use of the conveyance reading method, the reading optical box 30*a* is kept on standby at its reading position C, and the original is read by the reading portion while the original is conveyed at a preset speed by the ADF 10.

General Structure of ADF

Next, referring to FIGS. 2 and 3, the ADF is described about its structure. Referring to FIG. 2, the ADF 10 is provided with an original placement tray 121, a pickup roller 101, a separation roller 102, a pair of retard rollers, a pair of puller rollers 104, and a pair of registration rollers 105. Further, it is provided with a pair of conveyance rollers 106, a pair of conveyance rollers 108, a platen roller 107, a platen roller 109, a pair of discharge rollers 111, an original discharge tray 123, a glass platen 205 for reading the back surface of the original, an optical box 30*b* for reading the back surface of the original, etc.

The procedure for scanning an original with the use of the ADF 10 and the conveyance reading method is as follows: First, a user is to place an original on the original placement tray 121 in such an attitude that the first surface of the original faces upward. The original placement tray 121 is provided with an unshown sensor for detecting the size of an original. It is structured so that the sensor can recognize the length and width of the original. The original is read through a sequence which corresponds to the recognized original size.

To describe in greater detail, in a case where originals are read while they are being fed by the ADF 10, a few of the originals in the original placement tray 121 are fed into the ADF 10 by the pickup roller 101, and are sent into the separation nip between the separation roller 102 and retard roller 103. The ADF 10 is structured so that unless the retard roller 103 is subjected to a preset amount of torque, which is controlled by a torque limiter, it does not rotate in the recording medium conveyance direction. Thus, as the separation roller 102, with which the retard roller 103 is kept in contact with the application of a preset amount of pressure, rotates in the recording medium conveyance direction, the original which is in contact with the separation roller 102 is separated from the rest.

After the separation of the top original from the rest, it is conveyed to the nip between the pair of puller rollers 104, which are kept stationary until the arrival of the original. Thus, as the original arrives at the nip, it is held by the nip. However, the original is being pushed by the separation roller 102 which is on the upstream side of the pair of puller rollers 104 in terms of the recording medium conveyance direction. Thus, the rear portion of the original is pushed into the space between the separation roller 102 and the pair of puller rollers 104. Consequently, the original is made to curve. Thus, the front edge of the original conforms to the nip between the puller rollers 104. Consequently, the original is corrected in attitude if it happens to be being conveyed askew. Thereafter, the original is conveyed further by the puller rollers 104 as if it is pulled out of the separation nip, and is conveyed to the nip of the pair of registration rollers 105, which also corrects the original in attitude like the pair of puller rollers 104. In this embodiment, the original is corrected twice in attitude as described above. Therefore, it is further ensured that the original is delivered to the image forming portion 102, in the correct attitude.

After the correction of the original in attitude as described above, the original is continuously conveyed further by the pair of registration rollers 105 by way of the pair of conveyance rollers 106, and through the nip between the glass platen 204 and platen roller 107, at a preset speed. While the original is conveyed through the nip between the glass platen 204 and platen roller 107, the first (top) surface of the original is read. In a case where the image reading apparatus is in the mode for reading the second (back) surface of the original after the first one, the second (back) surface of the original is read by the optical box 30*b* for reading the second (back) surface of the original, at a reading point of the glass platen 205. Then, the original is discharged into the delivery tray 123 for the originals by the pair of discharge rollers 111. By the way, in this embodiment, the optical box 30*b* for reading the second (back) surface of an original makes up another means for reading the image on a sheet of recording medium, which is conveyed through the sheet passage.

Positioning of Sensor Protection Metallic Shaft

Next, the positioning of the metallic shaft for protecting a sensor is described. Referring to FIGS. 2 and 3, the ADF 10 is structured so that while an original is conveyed from the adjacencies of the pair of puller rollers 104 to the adjacencies of the pair of registration rollers 105, the downwardly facing surface of the original is guided by the sheet guide 12. The sheet guide 12 is formed of a resinous substance. It makes up a part of the aforementioned sheet passage 150.

Figure 4:
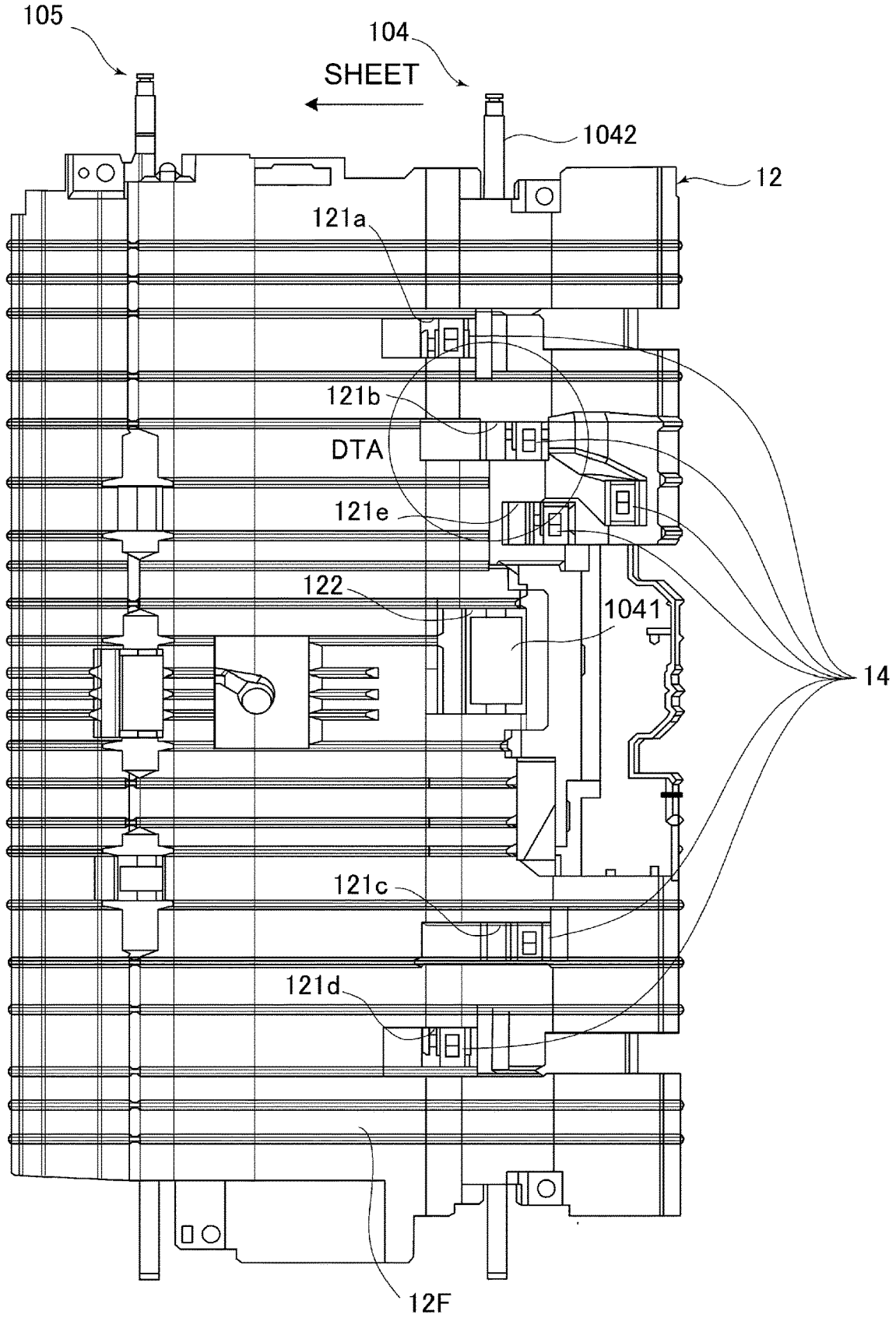
FIG. 4 is a top view of the sheet guide and adjacent components in the first embodiment.

FIG. 4 is a schematic top view of the sheet guide 12 and adjacent components of the image reading apparatus 20. The guiding surface (wall) 12F of the sheet guide 12 is provided with multiple (four) rectangular holes 121*a*-121*d*. These holes 121*a*-121*d* are positioned so that the sheet sensor 14 is exposed to the sheet passage 150 (FIG. 2) through one of the holes. It is through one of these holes 121*a*-121*d* that the beam of infrared light from the light source 310 is projected into the sheet passage. Thus, as an original passes above the sheet sensor 14, the original reflects the beam of infrared light, and the reflected infrared light is detected by the sheet sensor 14. That is, as an original moves through the sheet passage, the light emitted by the light source 310 and reflected by the original is detected by the light sensing element of the sheet sensor 14. By the way, the sheet sensor 14 does not need to be such a sensor that uses infrared light as the sheet detection light. For example, it may be a sensor that uses ultrasonic waves as sheet detecting means. That is, all that is required of the sheet sensor 14 is that it projects detection waves toward the sheet passage 150, and detects the presence (absence) of the sheet by detecting the portion of the detection waves reflected by the sheet.

The first role of this sensor in this apparatus is to detect the occurrence of JAM (jamming of original) to stop the apparatus before the apparatus is seriously damaged. For example, it detects the occurrence of the delay JAM, that is, the problem that an original is not detected by a downstream sensor after the elapse of a preset length of time after the detection of the original by the upstream sensor. The second role of this sensor is to detect the distance between the two originals which are being consecutively conveyed. In a case where it is determined by this sensor that this distance has become greater than the preset value for such a reason as instability in the sheet conveyance efficiency of the apparatus, the upstream roller can be increased in speed to make the apparatus stable in recording medium interval to increase the apparatus in productivity.

Further, the sheet guide 12 is provided with a hole 122 for allowing the actual roller portion 1041 of the bottom one of the pair of puller rollers 104 (which hereafter will be referred to simply as puller roller) to be exposed to the sheet passage 150, in addition to the aforementioned holes for the exposure of the sheet sensor 14. The actual roller portion 1041 is supported by a metallic rotational shaft 1042. Thus, the puller roller 104*a* functions a sheet conveyance roller, since the actual roller portion 1041 conveys an original by rotating.

Figure 5:
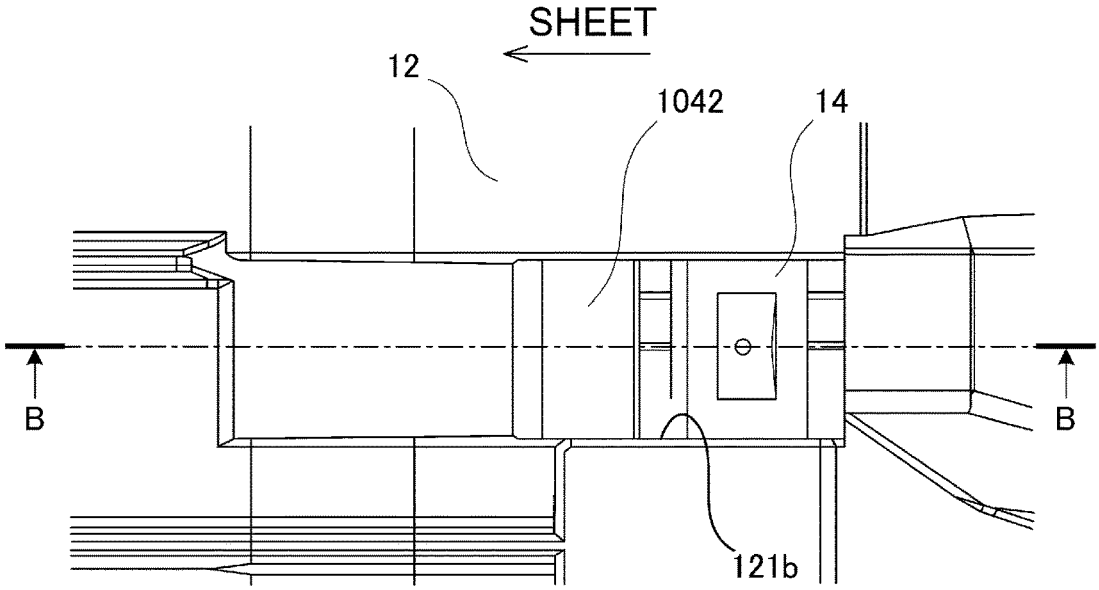
FIG. 5 is an enlarged view of the DTA portion in FIG. 4.
Figure 6:
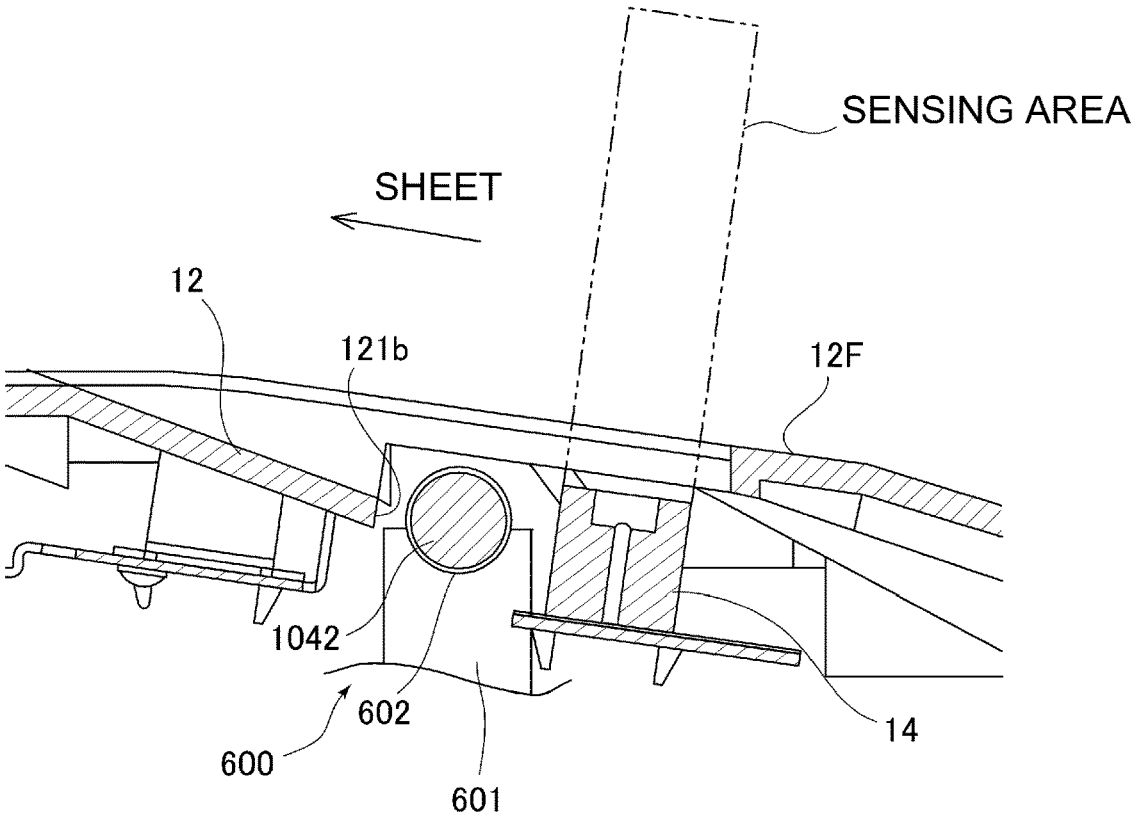
FIG. 6 is a sectional view of DTA portion at a plane B-B in FIG. 5.

FIG. 5 is an enlarged schematic view of the DTA portion in FIG. 4. FIG. 6 is a sectional view of the DTA portion at a plane B-B in FIG. 5. Next, referring to FIGS. 5 and 6, the DTA portion is described about the structure of the adjacencies of the rectangular hole 121*b* is described. By the way, the structure of the adjacencies of the sensor which corresponds in position to the rectangular hole 121*c*, which is on the opposite side of the actual roller portion 1041 of the puller roller 104*a* which is in the middle of the sheet passage, in terms of the sheet conveyance direction, is the same as that of the adjacencies of the sensor which corresponds in position to the rectangular hole 121*b*. Therefore, it is not described.

Referring to FIG. 5, the ATA portion is structured so that in terms of the sheet conveyance direction, the rectangular hole 121*b* is wider than the exposed portion of the sheet sensor 14. Further, the shaft portion 1042 of the puller roller 104*a* is positioned in the downstream space of the rectangular hole 121*b* with reference to the sheet sensor 14, being exposed to the sheet passage through the rectangular hole 121*b* like the sensor 14.

The shaft portion 1042 of the puller roller 104*a* is formed of a metallic substance. It is grounded through a metallic bearing 602, which is on the back side of the apparatus, and a metallic frame 602*a* which supports the metallic bearing 602. In this embodiment, these metallic bearing 602 and frame 601 make up a grounding member 600 for grounding the metallic shaft 1042.

In terms of the recording medium conveyance direction, the sheet sensor 14 is in the range of the hole 121*b*, and the grounded metallic shaft 1042 is positioned in the adjacencies of the sheet sensor 14. Therefore, even if static electricity is discharged from the charged original when the original passes through the adjacencies of the sheet sensor 14, the static electricity is discharged to the metallic shaft 1042 instead of the sheet sensor 14. Therefore, it is possible to prevent the sheet sensor 14 from being damaged by the static electricity from the original.

By the way, the DTA may be structured so that the metallic shaft 1042 and sheet sensor 14 are separately exposed from each other through adjacently positioned two holes. However, it is desired that the metallic shaft 1042 and sheet sensor 14 are exposed through the same hole. With the metallic shaft 1042 and sensor 14 being exposed through the same hole, the shaft 1042 and sheet sensor 14 can be positioned closer to each other than otherwise. Further, with the shaft 1042 and sheet sensor 14 being exposed through the same hole, there is nothing to shield them from each other, making it easier for the static electricity of the original to be discharged to the metallic shaft 1042.

That is, in this embodiment, the sheet guiding surface (wall) 12F is provided with the hole 121*b* for exposing the shaft portion 1042 of the sheet roller 104*b*. In particular, in this embodiment, not only is the shaft portion 1042 of the sheet roller 104*b* exposed to the sheet passage 150, but also, the sheet sensor 14. Therefore, even if a charged sheet happens to be conveyed to the adjacencies of the sheet sensor 14, the static electricity of the sheet is discharged to the grounded metallic shaft 1042 instead of the sheet sensor 14. Therefore, it is possible to protect the sheet sensor 14 from the static electricity.

From the standpoint of making it easier for the static electricity of an original to discharge to the metallic shaft 1042, the width by which the metallic shaft 1042 is exposed through the rectangular hole 121*b* in terms of the lengthwise direction of the shaft portion 1042 is desired to be the same as, or greater than, the width of the sheet sensor 14, as shown in FIG. 5. With the metallic shaft 1042 being exposed as described above, even if the static electricity is discharged from the portion of the sheet, which is on the front or back side of the lengthwise ends of the metallic shaft 1042, it is ensured that the static electricity is guided to the metallic shaft 1042.

Further, referring to FIG. 6, which is a sectional view of the DTA at the plane which is parallel to the primary scan direction, and which coincides with the sensor, the sheet sensor 14 and metallic shaft 1042 are positioned lower than the upstream edge 12*a* of the hole 121*b* in terms of the sheet conveyance direction. With the metallic shaft 1042 being positioned in this manner, even in a case where the sheet sensor 14 and metallic shaft 1042 are exposed to the sheet passage through the hole, with which the sheet guide 12 is provided, it is possible to prevent the leading edge of an original from being caught by the sheet sensor 14 and/or metallic shaft 1042.

Figure 7:
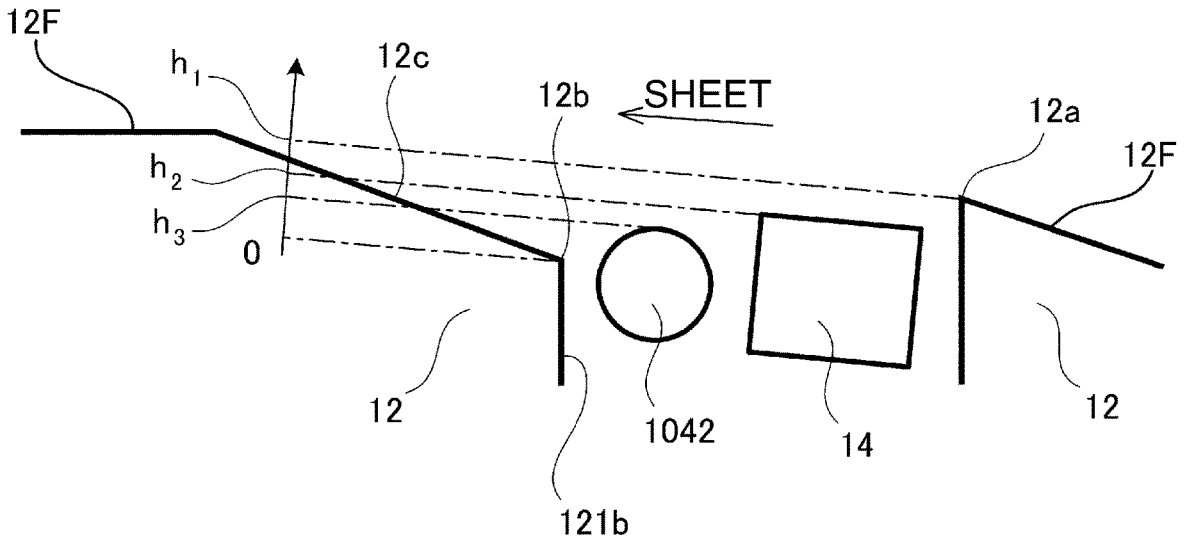
FIG. 7 is a schematic sectional view of the sheet guide in the first embodiment.

At this time, referring to FIG. 7, which is a schematic drawing of the portion of the DTA in FIG. 6, a preferred structure for the DTA is described. In this case, the downstream portion of the sheet guide 12 with reference to the sheet sensor 14 is provided with a tilted portion 12*c*. That is, in terms of the direction which is perpendicular to the sheet conveyance direction, the downstream portion 12*b* of the sheet guide 12 with reference to the hole 121*b* is below the guiding surface 12F of the sheet guide 12. Further, the tilted portion 12*c* is tilted in such a manner that the more downstream it is in terms of the sheet conveyance direction, the smaller the distance between the guiding surface 12F and tilted portion 12*c*. With the sheet guide 12 being provided with the tilted portion guide 12*c* which is tilted as described above, even if an original is conveyed, with its leading edge sliding on the sheet sensor 14 and/or metallic shaft 1042, the leading edge of the original can be scooped up by the sheet guide 12, without being caught by the downstream edge 12*b* of the rectangular hole 121*b* of the sheet guide 12.

Here, in terms of the direction which is perpendicular to the sheet conveyance direction, the top side of the downstream edge 12*b* of the rectangular hole 121*b* of the sheet guide 12 is referred to as the positive side. Further, the height of the upstream edge 12*a* of the rectangular hole 121*b* of the sheet guide 12 with reference to the downstream edge 12*b* of the rectangular hole 121*b* of the sheet guide 12 is referred to as h1; the top of the sheet sensor 14, h2; and the top of the metallic shaft 1042 is referred to as h3. If the relationship among h1, h2 and h3 is such that h1>h2>h3, the DTA is better in sheet conveyance.

As described above, in this embodiment, the sheet guiding surface 12F of the sheet guide 12 is provided with the hole 121*b*, through which the shaft portion 1042 of the sheet roller 104*b* is exposed to the sheet passage 150. In particular, in this embodiment, the DTA is structured so that not only the shaft portion 1042 of the sheet roller 104*b* is exposed to the sheet passage 150 through the hole 121*b*, but also, the sheet sensor 14. Therefore, even if a charged sheet is conveyed to the adjacencies of the sheet sensor 14, the static electricity of the sheet is discharged to the grounded metallic shaft 1042, instead of the sheet sensor 14. Therefore, it is possible to protect the sheet sensor 14 from the static electricity.

Further, the shaft portion 1042 is exposed to the sheet passage at a different position (downstream side of sheet sensor 14) from the sheet sensor 14, in terms of the sheet conveyance direction. Further, in terms of the direction which is parallel to the shaft portion 1042, the width by which the shaft portion 1042 is exposed to the sheet passage through the hole 121*b* is greater than the width by which sheet sensor 14 is exposed to the sheet passage through the hole 121*b*. Therefore, the shaft portion 1042 can cover the entirety of the sheet sensor 14 in terms of the direction parallel to the shaft portion 1042, making it possible to more effectively protect the sheet sensor 14 from the static electricity.

Moreover, in terms of the direction which is perpendicular to the sheet conveyance direction, the sheet sensor 14 and shaft portion 1042 are positioned lower than the upstream edge 12*a* of the hole 121*b* in terms of the sheet conveyance direction. Therefore, it is possible to prevent the problem that as a sheet arrives at the sheet sensor 14 and/shaft portion 1042, it is prevented from being conveyed further. In particular, in this embodiment, the shaft portion 1042 is positioned so that it is exposed to the sheet passage 150, on the downstream side of the sheet sensor 14 in terms of the sheet conveyance direction. Further, the DTA is structured so that in terms of the direction which is perpendicular to the direction in which a sheet is conveyed through the nip between the pair of puller rollers 140, the upstream edge 12*a* of the hole 121*b* in terms of the sheet conveyance direction is positioned higher than the top of the sheet sensor 14, which is positioned higher than the top of the shaft portion 1042, which is positioned higher than the downstream edge 12*b* of the hole 121*b* in terms of the sheet conveyance direction. Therefore, it is ensured that the problem that the sheet conveyance is interfered is prevented.

Embodiment 2

Figure 8:
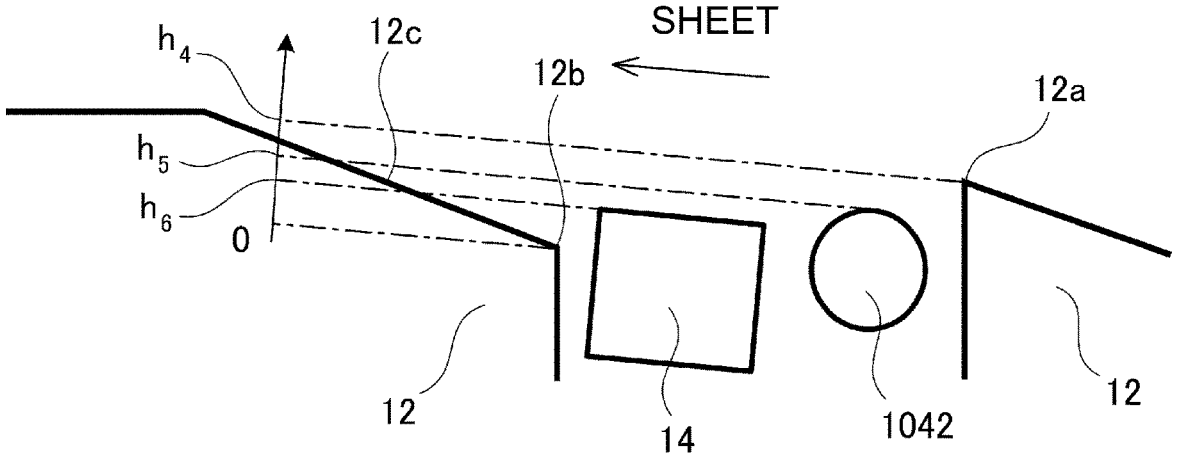
FIG. 8 is a schematic sectional view of the sheet guide in the second embodiments.

Next, referring to FIG. 8, the second embodiment of the present invention is described. This embodiment is different from the first one only in that in this embodiment, the metallic shaft 1042 is positioned on the upstream side of the sheet sensor 14 in terms of the sheet conveyance direction. That is, even if the sheet sensor 14 and metallic shaft 1042 are switched in position, the sensor can be protected from the static electricity as effectively as in the first embodiment.

By the way, in this embodiment, when an original, in which static electricity has been cumulatively stored, approaches the rectangular hole 121*b*, the metallic shaft 1042 is closer to the original than the sheet sensor 14. Therefore, this embodiment is more effective to protect the sheet sensor 14 from the static electricity. Further, from the standpoint of sheet conveyance, the DTA is desired to be structured so that an inequality: h4>h5>h6>h0 is satisfied, in which h4, h5, and h6 stand for the height of the upstream edge 12*a* of the hole 121*b* in terms of the sheet conveyance direction, top of the shaft portion 1042, top of the sheet sensor 14, and the downstream edge 12*b* of the hole 121*b* in terms of the sheet conveyance direction, respectively.

That is, in this embodiment, the shaft portion 1042 is positioned so that it is exposed to the sheet passage 150, on the upstream side of the sheet sensor 14 in terms of the sheet conveyance direction. In such a case, the DTA is desired to be structured so that in terms of the direction which is perpendicular to the sheet conveyance direction, the upstream edge 12*a* of the hole 121*b* in terms of the sheet conveyance direction is positioned higher than the top of the shaft portion 1042, which is positioned higher than the top of the sheet sensor 14, which is positioned higher than the downstream edge 12*b* of the hole 121*b* in terms of the sheet conveyance direction.

By the way, in the preceding embodiments, it was the ADF 10 that was structured so that the metallic shaft 1042 and sheet sensor 14 are positioned as described above. However, the effect of this structural arrangement is not limited to the ADF. That is, even if this structural arrangement is applied to such a sheet feeding device as the sheet conveying portion 405 of the image forming apparatus, which conveys sheets in the printing portion 40 of the image forming apparatus, effect similar to the one obtained by these embodiments can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-008083 filed on Jan. 21, 2019 which is hereby incorporated by reference herein in its entirety.

What is claimed is:

1. A sheet feeding device comprising:

a feeding roller configured to feed a sheet, said feeding roller comprising a metal shaft;

a feeding guide of resin material constituting a sheet feeding path through which the sheet fed by said feeding roller passes;

a sheet sensor configured to detect the sheet fed by said feeding roller; and a grounding member electrically grounding said shaft, wherein said feeding guide comprises a guiding surface configured to guide the sheet, wherein said guiding surface is provided with a hole portion, and wherein said shaft and said sheet sensor are exposed to said sheet feeding path through said hole portion.

2. A sheet feeding device according to claim 1, wherein said shaft is exposed to said sheet feeding path at a position different from said sheet sensor in a sheet feeding direction in which the sheet is fed, and wherein a width of said hole portion, as measured in a direction of an axis of said shaft, through which said shaft is exposed is not less than a width of said hole portion, as measured in the direction of the axis, through which said sheet sensor is exposed.

3. A sheet feeding device according to claim 1, wherein said sheet sensor and said shaft are disposed at a level lower than an upstream end of said hole portion with respect to the sheet feeding direction, in a direction perpendicular to the sheet feeding direction.

4. A sheet feeding device according to claim 3, wherein said shaft is disposed such that it is exposed to said sheet feeding path at a position which is downstream of said sheet sensor in the sheet feeding direction, and wherein a position of an upstream end of said hole portion in the sheet feeding direction, a position of an upper portion of said sheet sensor, a position of an upper portion of said shaft portion, and a position of a downstream end of said hole portion decrease in height in the order named.

5. A sheet feeding device according to claim 1, wherein said shaft is disposed such that it is exposed to said sheet feeding path at a position which is upstream of said sheet sensor in the sheet feeding direction, and wherein a position of an upstream end of said hole portion in the sheet feeding direction, a position of an upper portion of said shaft portion, a position of an upper portion of said sheet sensor, and a position of a downstream end of said hole portion decrease in height in the order named.

6. A sheet feeding device according to claim 1, wherein in a direction perpendicular to the sheet feeding direction, a downstream end of said hole portion in the sheet feeding direction is disposed at a level lower than a portion of said guiding surface of said feeding guide, and wherein said feeding guide comprises a surface inclined such that it approaches to the portion of said guiding surface from the downstream end of said hole portion with respect to the sheet feeding direction, as it goes toward downstream in the sheet feeding direction.

7. A sheet feeding device according to claim 1, wherein said sheet sensor is configured to irradiate a detection wave toward said sheet feeding path and to detect the detection wave reflected by the sheet.

8. A sheet feeding device according to claim 1, further comprising an image reading device configured to read an image on the sheet being fed along said sheet feeding path.

9. A sheet feeding device according to claim 1, wherein said feeding roller further comprises a roller portion supported by said shaft, wherein said guiding surface is provided with another hole portion, and wherein said roller portion is exposed to said sheet feeding path through said another hole portion so as to feed the sheet.

10. A sheet feeding device comprising:

a feeding roller configured to feed a sheet, said feeding roller comprising (a) a metal shaft and (b) a roller portion supported by said shaft;

a feeding guide of resin material constituting a sheet feeding path through which the sheet fed by said feeding roller passes;

a sheet sensor configured to detect the sheet fed by said feeding roller; and a grounding member electrically grounding said shaft, wherein said feeding guide comprises a guiding surface configured to guide the sheet, wherein said guiding surface is provided with a first hole portion and a second hole portion, wherein said shaft is exposed to said sheet feeding path through said first hole portion, and wherein said roller portion is exposed to said sheet feeding path through said second hole portion so as to feed the sheet.

11. A sheet feeding device according to claim 10, wherein in a direction perpendicular to the sheet feeding direction, a downstream end of said first hole portion in the sheet feeding direction is disposed at a level lower than a portion of said guiding surface of said feeding guide, and wherein said feeding guide comprises a surface inclined such that it approaches to the portion of said guiding surface from the downstream end of said hole portion with respect to the sheet feeding direction, as it goes toward downstream in the sheet feeding direction.

12. A sheet feeding device according to claim 10, wherein said sheet sensor is configured to irradiate a detection wave toward said sheet feeding path and to detect the detection wave reflected by the sheet.

13. A sheet feeding device according to claim 10, further comprising an image reading device configured to read an image on the sheet being fed along said sheet feeding path.

* * * * *